US008920259B2

(12) United States Patent
Takechi

(10) Patent No.: US 8,920,259 B2
(45) Date of Patent: Dec. 30, 2014

(54) GOLF CLUB HEAD

(71) Applicant: Bridgestone Sports Co., Ltd, Minato-ku, Tokyo (JP)

(72) Inventor: Takaharu Takechi, Saitama (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 118 days.

(21) Appl. No.: 13/693,443

(22) Filed: Dec. 4, 2012

(65) Prior Publication Data

US 2013/0150177 A1 Jun. 13, 2013

(30) Foreign Application Priority Data

Dec. 7, 2011 (JP) ..... 2011-268329

(51) Int. Cl.
*A63B 53/04* (2006.01)
*A63B 59/00* (2006.01)

(52) U.S. Cl.
CPC ..... *A63B 53/047* (2013.01); *A63B 59/0092* (2013.01); *A63B 2053/0491* (2013.01); *A63B 2053/042* (2013.01)
USPC ..... 473/329; 473/332; 473/342; 473/349; 473/350

(58) Field of Classification Search
CPC ..... A63B 59/0088; A63B 2053/0416; A63B 2053/042; A63B 2053/0425; A63B 2053/0429
USPC ..... 473/324–350, 287–292
See application file for complete search history.

(56) References Cited

U.S. PATENT DOCUMENTS

| | | | | |
|---|---|---|---|---|
| 5,492,327 | A * | 2/1996 | Biafore, Jr. | 473/332 |
| 6,045,456 | A * | 4/2000 | Best et al. | 473/291 |
| 6,976,924 | B2 * | 12/2005 | Gilbert et al. | 473/332 |
| 7,303,486 | B2 * | 12/2007 | Imamoto | 473/332 |
| 7,597,633 | B2 * | 10/2009 | Shimazaki et al. | 473/329 |
| 7,713,141 | B2 | 5/2010 | Yamamoto | |
| 7,871,338 | B2 * | 1/2011 | Nakano | 473/332 |
| 2005/0143188 | A1 * | 6/2005 | Tseng | 473/332 |
| 2007/0129162 | A1 * | 6/2007 | Pan et al. | 473/332 |
| 2008/0305888 | A1 * | 12/2008 | Tseng | 473/332 |

FOREIGN PATENT DOCUMENTS

| | | |
|---|---|---|
| JP | 2008-036006 A | 2/2008 |
| JP | 2008-272241 A | 11/2008 |

* cited by examiner

*Primary Examiner* — Sebastiano Passaniti
(74) *Attorney, Agent, or Firm* — Sughrue Mion, PLLC

(57) ABSTRACT

An iron golf club head according to this invention includes a head body and a face member. The face member includes a front portion forming portion which forms the front portion of a sole portion. The head body includes a sole forming portion thicker than the front portion forming portion. The end surface of the sole forming portion on the side of a face portion includes a lower region attached to the end surface of the front portion forming portion on the back side, and an upper region above the lower region. An elastic body is disposed in the gap between the upper region and the back surface of the face member.

4 Claims, 4 Drawing Sheets

GOLF CLUB HEAD

BACKGROUND OF THE INVENTION

1. Field of the Invention

The present invention relates to an iron golf club head.

2. Description of the Related Art

As the structure of an iron golf club head, a golf club head formed by fastening a face member and a head body together is known (Japanese Patent Laid-Open Nos. 2008-36006 and 2008-272241). Japanese Patent Laid-Open No. 2008-36006 discloses a golf club head including a shock absorbing member interposed between a face member and a head body. Japanese Patent Laid-Open No. 2008-272241 discloses a golf club head formed by bending the lower end portion of a face member to allow the lower portion of the face portion to easily flex.

When the lower portion of the face portion can easily flex, a decrease in flight distance can be suppressed when a golf ball is struck by the lower portion of the face portion away from the sweet spot of the face portion. However, the larger the amount of flexure, the more uncomfortable the impact feel becomes.

SUMMARY OF THE INVENTION

It is an object of the present invention to improve an impact feel while allowing the lower portion of a face portion to easily flex.

According to an aspect of the present invention, there is provided a iron golf club head including a face portion and a sole portion, the head comprising: a head body; and a face member attached to the head body, wherein the face member includes a face forming portion which forms the face portion, and a front portion forming portion which extends from the face forming portion to a back side, and forms a front portion of the sole portion, the head body includes a peripheral edge portion defining an opening through which a back surface of face member is exposed, the peripheral edge portion includes a sole forming portion which forms the sole portion, the sole forming portion is thicker than the front portion forming portion, an end surface of the sole forming portion on a side of the face portion includes a lower region attached to an end surface of the front portion forming portion on the back side, and an upper region above the lower region, and an elastic body is disposed in a gap between the upper region and a back surface of the face member.

Further features of the present invention will become apparent from the following description of exemplary embodiments with reference to the attached drawings.

DESCRIPTION OF THE EMBODIMENTS

Figure 1:
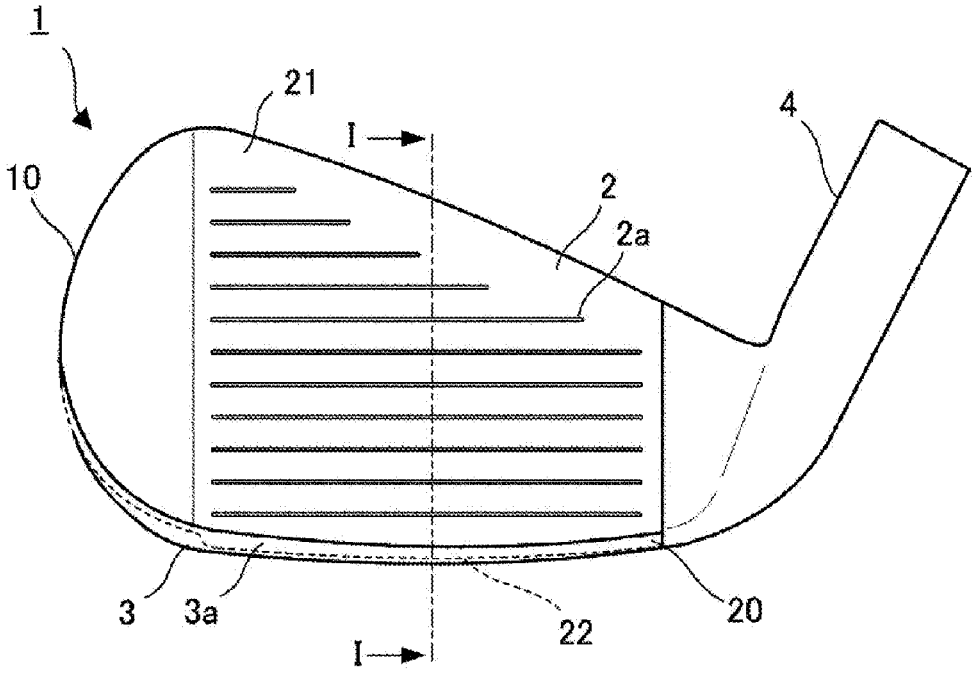
FIG. 1 is an external view of a golf club head according to an embodiment of the present invention.

FIG. 1 is an external view of an iron golf club head 1 according to the first embodiment of the present invention and, more specifically, a perspective view of the golf club head 1 when viewed from the side of a face portion. The present invention is suitable to general iron golf club heads.

The golf club head 1 includes a face portion (striking surface) 2, sole portion 3, and hosel portion 4. A shaft (not shown) is attached to the hosel portion 4. A plurality of scorelines 2*a* are formed in the face portion 2. The scorelines 2*a* are parallel linear grooves extending in the toe-to-heel direction.

Figure 2A:
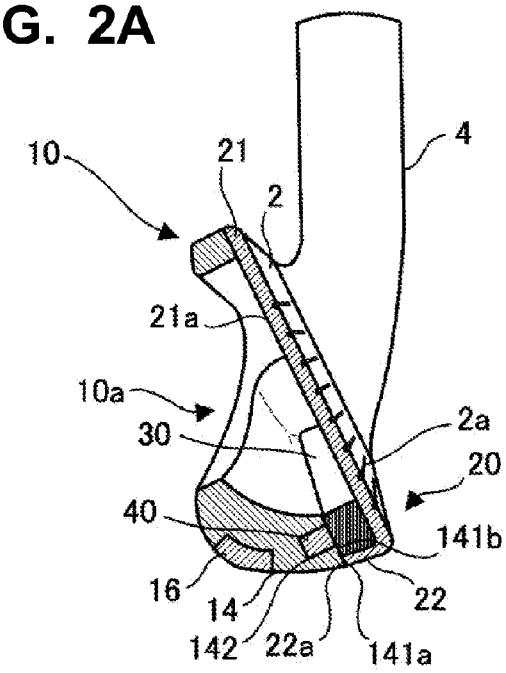
FIG. 2A is a sectional view taken along a line I-I in FIG. 1.
Figure 3:
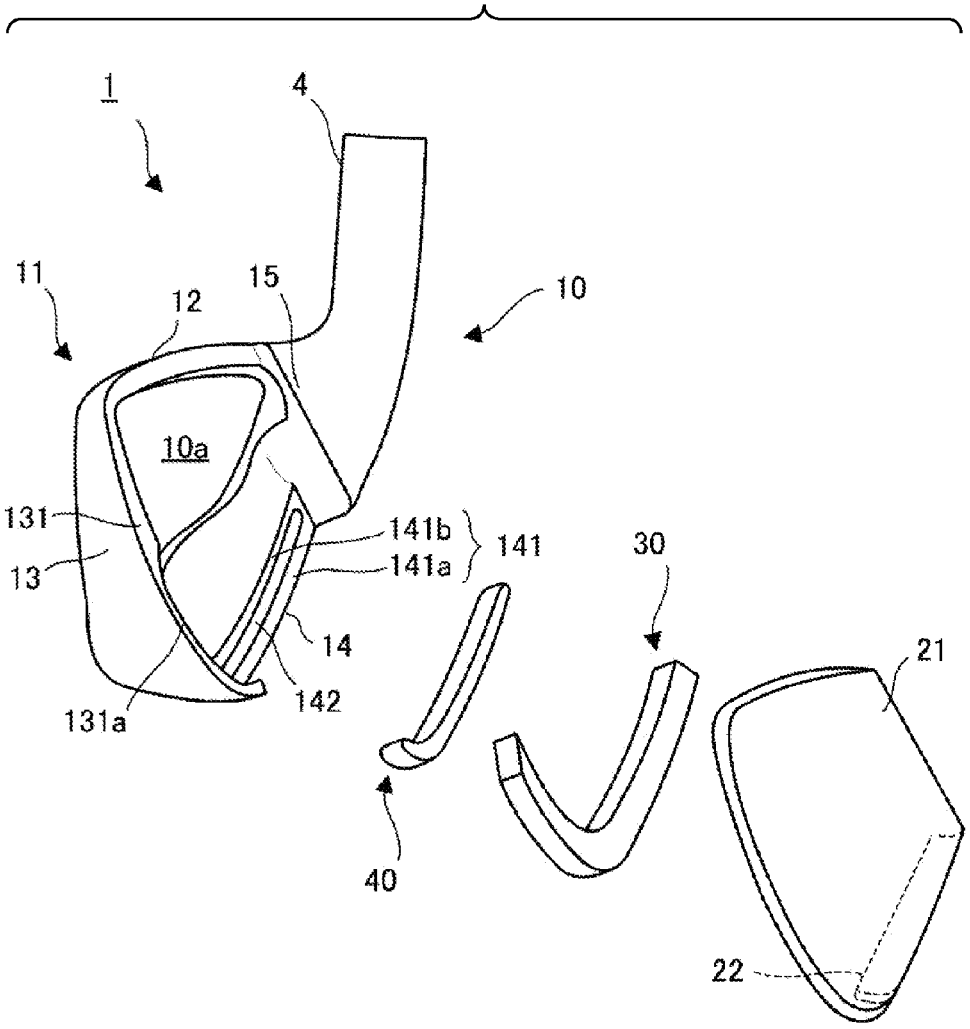
FIG. 3 is an exploded perspective view of the golf club head shown in FIG. 1.
Figure 4:
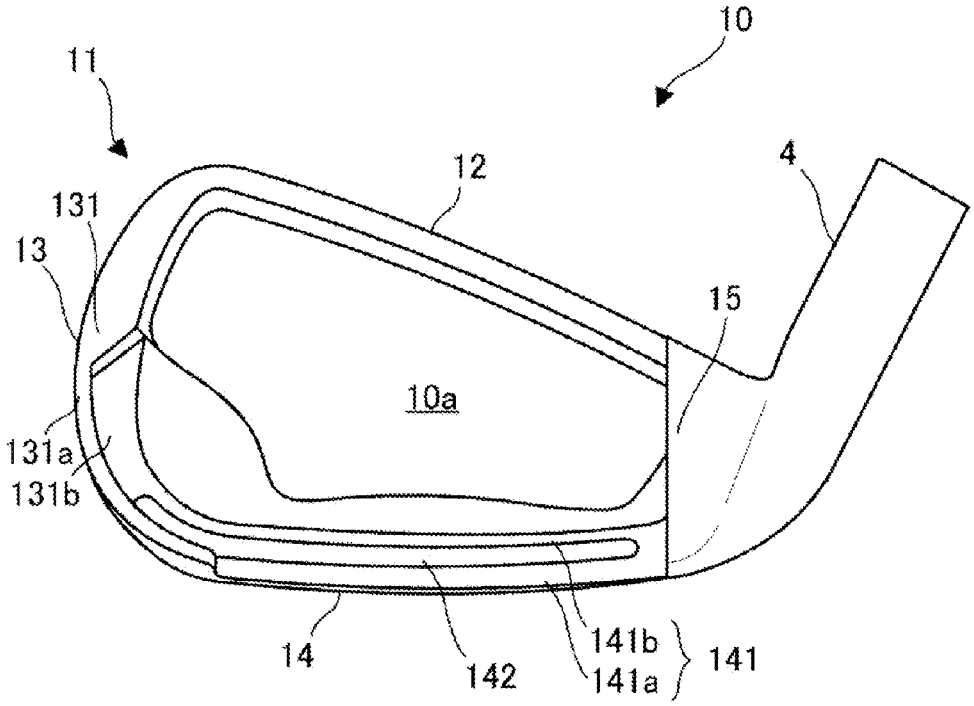
FIG. 4 is an external view of the body of the golf club head shown in FIG. 1.

The golf club head 1 includes a head body 10 and a face member 20 attached to the head body 10. FIG. 2A is a sectional view taken along a line I-I in FIG. 1, FIG. 3 is an exploded perspective view of the golf club head 1, and FIG. 4 is an external view of the head body 10 when viewed from the side of the face portion 2.

The face member 20 includes a face forming portion 21, and a front portion forming portion 22 extending from the lower end portion of the face forming portion 21 to the back side. The face forming portion 21 has a front surface which forms the face portion 2. The front portion forming portion 22 forms a front portion 3*a* of the sole portion 3 (its portion on the side of the face portion 2).

The face member 20 is formed by a metal material such as a titanium alloy, stainless steel, maraging steel, or a steel alloy. The face member 20 can be formed by, for example, casting, forging, or press forging in which a plate member is pressed and molded. Forging is advantageous in terms of ease in forming a complex shape.

The head body 10 includes the hosel portion 4. The head body 10 also includes an opening portion 10*a* through which the back surface of the face member 20 (a back surface 21*a* of the face forming portion 21) is exposed to the back side. The opening portion 10*a* is defined by a peripheral edge portion 11.

The peripheral edge portion 11 includes an upper portion forming portion 12, toe-side side forming portion 13, sole forming portion 14, and heel-side side forming portion 15. The side forming portion 13 forms the toe-side side portion of the golf club head 1, and includes an end surface 131 on the side of the face portion 2. The end surface 131 is divided into an outer region 131*a* and an inner region 131*b* on the side of the sole portion 3. The inner region 131*b* is recessed more to the back side than the outer region 131*a*.

The sole forming portion 14 forms the sole portion 3 other than the front portion 3*a*, and includes an end surface 141 on the side of the face portion 2. The end surface 141 is virtually divided into two regions: a lower region 141*a* and an upper region 141*b* above the lower region 141*a*. The upper region 141*b* and inner region 131*b* are formed continuously with each other. A recessed portion 142 is formed in the upper region 141*b*. The recessed portion 142 extends from the heel side to the toe side, and extends up to the inner region 131*b* upon being slightly bent upwards on the toe side.

A weight member 16 for barycentric position adjustment is attached to the sole forming portion 14. The weight member 16 is attached to the recessed portion formed in the sole forming portion 14. The weight member 16 is formed by, for example, a metal material different from that of the head body 10.

In the face member 20, the back surface 21*a* of the face forming portion 21 is attached to the outer region 131*a* and the end surface of the upper portion forming portion 12 on the side of the face portion 2, and an end surface 22*a* of the front portion forming portion 22 on the back side is attached to the lower region 141*a*. The head body 10 and the face portion 2 are joined together by, for example, welding. The inner region

131*b* and the upper region 141*b* are spaced apart from the back surface 21*a* of the face forming portion 21.

The sole forming portion 14 is thicker than the front portion forming portion 22, as shown in FIG. 2A. Making the sole forming portion 14 relatively thick improves the rigidity and lowers the center of gravity of the golf club head. Also, making the entire face portion 2 including the front portion forming portion 22 relatively thin allows the face forming portion 21 to easily flex at the time of impact.

In this embodiment, a gap is formed between the end surface 141 of the sole forming portion 14 and the face forming portion 21 by providing the front portion forming portion 22. With this arrangement, the lower portion of the face forming portion 21 can easily flex. It is therefore possible to suppress a decrease in flight distance when a golf ball is struck by the lower portion of the face portion 2.

An elastic body 30 fills the gap between the end surface 141 of the sole forming portion 14 and the face forming portion 21 and, more specifically, the gap between the upper region 141*b* and the back surface 21*a* of the face forming portion 21, and is in tight contact with the upper region 141*b* and back surface 21*a*. The elastic body 30 is fixed to this gap by, for example, an adhesive.

The elastic body 30 is made of, for example, a synthetic resin material or a natural resin material (for example, natural rubber). The elastic body 30 is preferably made of a viscoelastic body such as NBR (acrylonitrile butadiene rubber). However, the elastic body 30 may be formed by mixing a metal powder in such a resin material to adjust the barycentric position. In this embodiment, as described above, the lower portion of the face forming portion 21 can easily flex, but an impact feel often deteriorates as the amount of flexure increases. However, this elastic body 30 facilitates vibration damping. Thus, in this embodiment, an impact feel can be improved while allowing the lower portion of the face portion 2 to easily flex.

In this embodiment, the elastic body 30 is formed in an L shape, and extends to the gap between the inner region 131*b* and the back surface 21*a* of the face forming portion 21 as well. This makes it possible to prevent impact feel deterioration when a golf ball is struck by a portion on the toe side away from the sweet spot of the face portion 2.

An insertion member 40 made of a material different from that of the head body 10 is inserted into the recessed portion 142. The material of the insertion member 40 can be appropriately selected in accordance with the purpose of use. If the insertion member 40 is used to adjust the barycentric position, it can be made of a material having a specific gravity different from that of the material of the head body 10. More particularly, if the insertion member 40 is used to lower the center of gravity, it can be made of a metal material having a specific gravity higher than that of the material of the head body 10.

If the insertion member 40 is used to improve an impact feel, it can be made of a metal material exhibiting a vibration damping performance higher than that of the head body 10. As the insertion member 40 is formed using a metal exhibiting a vibration damping performance higher than that of the head body 10, the elastic body 30 and insertion member 40 can improve an impact feel.

In this case, the insertion member 40 is preferably formed by a high-damping alloy. Examples of the high-damping alloy include flake graphite cast iron, a magnesium alloy, Silentalloy (Fe—Cr—Al), a Ni—Ti alloy, and a Mn—Cu alloy. When the insertion member 40 is made of a high-damping alloy, and the elastic body 30 is made of a resin material, the high-damping alloy damps vibration having relatively high frequencies, and the resin material damps vibration having relatively low frequencies, thereby widening the vibration damping range. Also, as the insertion member 40 is formed using a high-damping alloy, a given rigidity of the sole portion 3 can be ensured, and the center of gravity of the golf club head 1 can be lowered.

In this embodiment, the recessed portion 142 extends up to the inner region 131*b* upon being slightly bent upwards on the toe side, as described above. The insertion member 40 also extends up to the inner region 131*b* upon being slightly bent upwards on the toe side. Hence, when the insertion member 40 is made of a high-damping alloy, deterioration of impact feel when a golf ball is struck by a portion on the toe side away from the sweet spot of the face portion 2 can be prevented.

Figure 2B:
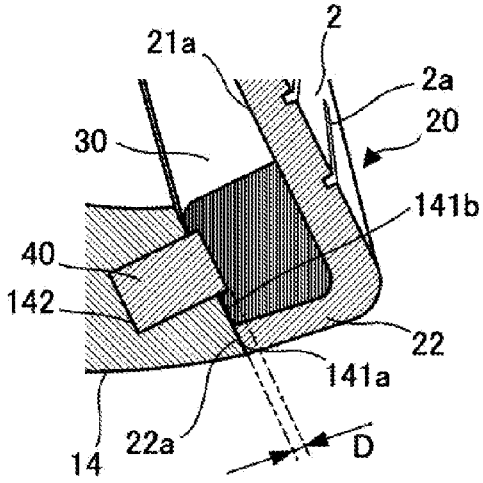
FIGS. 2B and 2C are views for explaining examples of other arrangements.
Figure 2C:
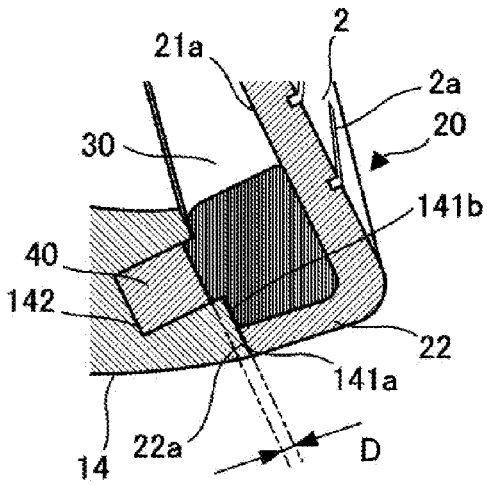

Note that a step D is preferably formed between an end surface 40*a* of the insertion member 40 on the side of the face portion 2, and the surface of the upper region 141*b*, as shown in FIGS. 2B and 2C. This means that a given difference is preferably set between the depth of the recessed portion 142 and the thickness of the insertion member 40. With this arrangement, the insertion member 40 projects from the upper region 141*b* (FIG. 2B) or recedes from the upper region 141*b* (FIG. 2C). In the arrangement shown in FIG. 2B, the distal end of the insertion member 40 extends into the elastic body 30. In the arrangement shown in FIG. 2C, the elastic body 30 extends into the recessed portion 142. In both cases, the elastic body 30 can be prevented from falling off.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-268329, filed Dec. 7, 2011, which is hereby incorporated by reference herein in its entirety.

What is claimed is:

1. An iron golf club head including a face portion and a sole portion, the head comprising:

a head body; and a face member attached to said head body, wherein said face member includes:

a face forming portion which forms the face portion, and a front portion forming portion which extends from said face forming portion toward a back side of the head, and forms a front portion of the sole portion, said head body includes:

a peripheral edge portion defining an opening through which a back surface of said face member is exposed, said peripheral edge portion includes:

a sole forming portion which forms the sole portion other than the front portion forming portion, said sole forming portion is thicker than said front portion forming portion, an end surface of said sole forming portion on a side of said face portion includes a lower region attached to an end surface of said front portion forming portion on the back side, and an upper region above said lower region, an elastic body is disposed in a gap between said upper region and the back surface of said face member, said upper region includes a recessed portion, and an insertion member made of a material different from a material of said head body is inserted into said recessed portion.

2. The head according to claim 1, wherein said elastic body is made of one of a synthetic resin material and a natural resin material, said head body is made of a metal, and said insertion member is made of a metal exhibiting a vibrating damping performance higher than a vibration damping performance of said head body.

3. The head according to claim 1, wherein a step is formed between an end surface of said insertion member on a side of the face portion, and a surface of said upper region.

4. An iron golf club head including a face portion and a sole portion, the head comprising:

a head body; and a face member attached to said head body, wherein said face member includes:

a face forming portion which forms the face portion, and a front portion forming portion which extends from said face forming portion toward a back side of the head, and forms a front portion of the sole portion, said head body includes:

a peripheral edge portion defining an opening through which a back surface of said face member is exposed, said peripheral edge portion includes:

a sole forming portion which forms the sole portion other than the front portion forming portion, said sole forming portion is thicker than said front portion forming portion, an end surface of said sole forming portion on a side of said face portion includes a lower region attached to an end surface of said front portion forming portion on the back side, and an upper region above said lower region, an elastic body is disposed in a gap between said upper region and the back surface of said face member, said peripheral edge portion includes a side forming portion which forms a toe-side side portion of the golf club head, an end surface of said side forming portion on a side of the face portion includes an outer region attached to the back surface of said face member, and an inner region spaced apart from the back surface of said face member, said inner region and said upper region are formed continuously, and said elastic body is formed in an L shape, and disposed in a gap between said inner region and said upper region, and the back surface of said face member.

* * * * *